United States Patent [19]

Müller

[11] Patent Number: 4,520,293

[45] Date of Patent: May 28, 1985

[54] HIGH FREQUENCY AMPLIFIER

[75] Inventor: Klaus-Rainer Müller, Mannheim-Vogelstang, Fed. Rep. of Germany

[73] Assignee: Kernforschungszentrum Karlsruhe GmbH, Karlsruhe, Fed. Rep. of Germany

[21] Appl. No.: 465,639

[22] Filed: Feb. 10, 1983

[30] Foreign Application Priority Data

Feb. 11, 1982 [DE] Fed. Rep. of Germany ..... 3204833

[51] Int. Cl.[3] ..... H01J 25/22

[52] U.S. Cl. ..... 315/5.25; 315/5; 315/5.27; 315/5.28

[58] Field of Search ..... 315/5.24, 5.25, 5.86, 315/5.27, 5.28, 39, 4, 5

[56] References Cited

U.S. PATENT DOCUMENTS

| | | | |
|---|---|---|---|
| 2,408,437 | 10/1946 | McRae | 315/5.25 |
| 2,515,998 | 7/1950 | Haeff | 315/5.25 |
| 2,870,374 | 1/1959 | Papp | 315/39 |
| 3,219,873 | 11/1965 | Kaufman | 315/5.25 |
| 3,221,207 | 11/1965 | Kaufman et al. | 315/5.25 |
| 3,885,193 | 5/1975 | Budker et al. | 315/5.25 |
| 4,019,088 | 4/1977 | Budker et al. | 315/5.25 |
| 4,210,845 | 7/1980 | Lebacqz | 315/5.25 |

FOREIGN PATENT DOCUMENTS

| | | | |
|---|---|---|---|
| 0069426 | 1/1983 | European Pat. Off. | 315/5.24 |

OTHER PUBLICATIONS

"Handbuch der Elektronik", München, Franzis-Verlag, 1979; pp. 426–429.

IEEE Transactions, vol. Ed.-26, No. 10, Oct. 1979, pp. 1559–1556.

Stanford Linear Accelertor Center Publication of 1979 Particle Accelerator Conference, San Francisco, CA, Mar. 12–14, 1979.

*Primary Examiner*—Saxfield Chatmon

*Attorney, Agent, or Firm*—Spencer & Frank

[57] ABSTRACT

A high frequency amplifier for a frequency range from 300 MHz to 3 GHz and having output power in the megawatt range. A beam generating device for generating a rotating electron beam includes an input resonator ring rotationally symmetric with respect to the amplifier axial axis and which presents a concentric input gap. A cathode ring disposed in front of the input gap generates the electron beam in response to an HF electrical field. The azimuthal angle width of that electron beam can be adjusted by means of a direct voltage between cathode ring and grid ring. An output resonator ring converts the kinetic energy of the beam electrons into HF power in dependence on the azimuthal angle width of the entering beam. The output resonator is rotationally symmetric with respect to the amplifier axis, axially spaced from and biassed with respect to the input resonator by a direct voltage. The axial space between the input and output resonators constitutes a direct voltage acceleration path which the electron beam traverses within an annular cylindrical region coaxial with the amplifier axis. A grid ring disposed opposite the cathode ring allows passage of the beam but prevents passage of an electrical field from the input resonator into the acceleration path. A collector is disposed on the side of the output resonator remote from the input resonator. The beam generating device, acceleration path, output resonator and collector are axially disposed one behind the other.

10 Claims, 4 Drawing Figures

HIGH FREQUENCY AMPLIFIER

BACKGROUND OF THE INVENTION

The present invention relates to a high frequency amplifier for the UHF range from 300 MHz to 3 GHz with an output power in the megawatt range.

More particularly, the invention relates to a high frequency amplifier of the type including a device for generating an electron beam, the device comprising an input resonator provided with an input gap in front of which a cathode ring is disposed. In such a device means are provided for generating a high frequency electrical field in the input resonator for stimulating the cathode to produce a rotating electron beam. A grid ring is provided at the side of the gap opposite the cathode ring so that the electron beam passes through the grid and is accelerated in a direct voltage acceleration path. The grid prevents the passage of the electrical field from the input resonator into the acceleration path. An output resonator is positioned to receive the beam and to convert the kinetic energy of the electrons, which enter the output resonator with approximately identical velocities, into high frequency electrical power in dependence on the azimuthal angle width of the beam.

High frequency amplifiers operating in a frequency range above 200 MHz to several GHz with a power in the megawatt range are gaining increasing significance in relation to high current accelerators, as for example, the spallation neutron source and the accelerator breeder, and for use in fusion technology. The efficiency of such a power amplifier is of special interest, particularly because of rising energy costs.

A klystron is disclosed in the *Handbuch der Elektronik* (*Electronics Handbook*) published by Franzis-Verlag, Munich, 1st edition, 1979, pages 426–429, which is a UHF power amplifier in which the velocity of the electrons of an electron beam is modulated by the high frequency electric field of a control resonator. In a drift path downstream of the control resonator, electrons travelling at different velocities can catch up with one another and form electron bunches. In an output resonator, the density modulated electron beam is decelerated and its kinetic energy is converted to high frequency power. However, because the electron bunches travel, for structural and electrical reasons, at bunching angles lying in a range between 90° and 180°, only part of the electrons can be decelerated in an optimum manner and converted to HF power in the output resonator. The total high frequency efficiency of the klystron thus lies at about 65%.

For that reason, an amplification principle has been developed which produces the HF excitation of the output resonator by modulation of the azimuthal entrance angle width of the electron beam entering into the output resonator rather than by density modulation of the electron beam as in the klystron. A UHF power amplifier operating according to this principle is known as a radial gyrocon and is disclosed in the *IEEE Transactions on Electron Devices,* volume ED-26, No. 10, October 1979, pages 1559 to 1566. An electron beam of high velocity generated by an electron gun is deflected out of the axis of the gyrocon by a deflection resonator in which a rotating wave is generated, and is additionally deflected by a magnetic dipole so that the beam enters into an annular output resonator. The azimuthal angle width of the electron beam in the gyrocon is only about 60° and the velocity of all electrons is approximately equal so that almost completely deceleration of the electrons is possible. With suitable selection of the parameters a total HF efficiency of 80% can be realized. The known radial gyrocon, however, is very large, structurally complicated and requires additional electrical power for the magnetic dipole.

A UHF power amplifier known as a trirotron, which stands for triode producing a rotating beam for RF amplification, is disclosed in Stanford Linear Accelerator Center Publication 2266, presented at the 1979 Particle Accelerator Conference, San Francisco, California, March 12–14, 1979, and constitutes a further development of the gyrocon. The trirotron described therein is circular and includes a cathode ring disposed at the inside of the input gap of a cylindrical input resonator. During every negative halfwave of the high frequency, the cathode emits electrons which exit radially relative to the axis of the input resonator through a grid disposed opposite the cathode at the exterior wall of the resonator into a direct voltage acceleration path. In a likewise cylindrical output resonator which is coaxial with the input resonator, the accelerated electrons are slowed down and their kinetic energy is converted into HF power. The smaller the azimuthal angle width of the electron beam, the greater is the efficiency of the conversion, which may reach approximately 85% at a 60° angle. The smaller azimuthal angle width is realized by a direct electrical field which is superposed over the HF electrical field of the input resonator. The total efficiency of the known trirotron lies at 80%.

SUMMARY OF THE INVENTION

It is an object of the present invention to provide an improved trirotron having a compact design with increased electron beam current and wherein adjustment of the cathode and of the resonators with respect to one another is simplified and the cathode is more easily accessible.

The above and other objects are accomplished according to the invention wherein a high frequency amplifier for a frequency range from 300 MHz to 3 GHz and having an output power in the megawatt range is provided in which the amplifier has an axial axis and comprises: means for generating a rotating electron beam including a ring shaped input resonator which is rotationally symmetric with respect to the amplifier axis, the input resonator being formed to present an input gap concentric to the amplifier axis, means for generating a high frequency electrical field in the input resonator, and a cathode ring disposed in front of the input gap for generating an electron beam in response to the high frequency electrical field. A ring shaped output resonator is constructed for passage therethrough of the beam and for converting the kinetic energy of the electrons in the beam into high frequency power. The output resonator is rotationally symmetric with respect to the amplifier axis, axially spaced from the input resonator and electrically biased by a direct voltage potential difference with respect to the input resonator. The axial space between the input resonator and the output resonator constitutes a direct voltage acceleration path for the electrons emitted from the beam generating means. The electron beam traverses the acceleration path within an annular cylindrical region coaxial with the amplifier axis. The electrons of the beam enter the output resonator with substantially identical velocities and the kinetic energy of the electrons is converted in the output resonator to high frequency power in dependence on the azimuthal angle width of the beam. A grid ring is disposed at the side of the input resonator between the cathode ring and the output resonator, the electron beam exiting the beam generating means through the grid ring. The grid ring prevents the passage of an electrical field from the acceleration path into the input resonator. A collector is disposed on the side of the output resonator remote from the input resonator. The beam generating means, the acceleration path, the output resonator and the collector are axially disposed one behind the other in the direction of the amplifier axis.

Among the advantages realized with the high frequency amplifier according to the invention are that the cathode is more easily accessible and thus its adjustment is made easier, and that the cathode can be produced more easily even if it is an assembly of segments. Moreover, adjustment of the resonators with respect to one another is easier since this adjustment is effected in the axial direction instead of in the radial direction. Compared to the gyrocon described in the above noted IEEE article, the amplifier according to the present invention offers an opportunity to focus the electron beam, and, compared to the klystron, the amplifier of the present invention continuously excites the output resonator. Moreover, the power with reference to a certain structural volume is increased considerably compared to the klystron because a larger cathode is able to generate a larger electron current.

Another advantage of the amplifier according to the invention is that all of the electrical fields generated in the resonators are oriented in the direction of amplifier axis so that undesirable azimuthal electrical field components are eliminated.

DESCRIPTION OF THE PREFERRED EMBODIMENTS

Figure 1:
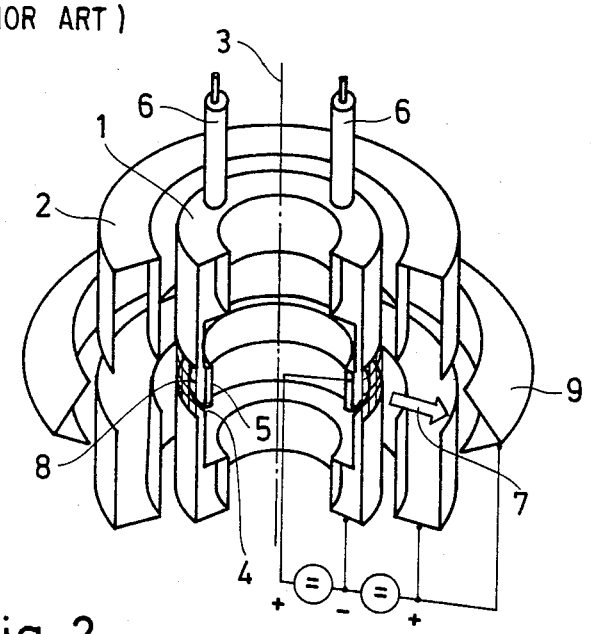
Fig. 1 ( PRIOR ART )
FIG. 1 is a perspective sectional view of a circular trirotron having a radial electron beam according to the prior art.

A UHF power amplifier in the form of a circular trirotron according to the prior art is shown in a simplified perspective sectional view in FIG. 1. An input resonator 1 and an output resonator 2 each having an annular shape are arranged coaxially with one another. A central region of input resonator 1 is constricted and presents a U-shaped cross-section with respect to axis 3 within which a gap 4 is located. A cathode ring 5 is disposed within the constricted region of input resonator 1 in front of input gap 4 and facing amplifier axis 3. A grid 8 is disposed at the side of input resonator 1 opposite cathode ring 5. Two coupling loops 6, angularly spaced by 90° from each other about axis 3, are used to couple two 90° phase shifted HF signals into input resonator 1 so that an HF wave rotating azimuthally about axis 3 is generated therein, with the circumference of input resonator 1 corresponding to one oscillation period of the HF wave. The negative halfwave of the HF oscillation causes cathode ring 5 to emit electrons; the positive halfwave prevents emission of electrons.

Since the HF wave passes cathode ring 5 in an azimuthal direction, an azimuthally rotating electron beam 7 is generated which passes through grid 8 into output resonator 2 after having undergone direct voltage acceleration. In output resonator 2 electron beam 7 generates an HF wave which rotates in the azimuthal direction and travels with electron beam 7 to convert the energy of the electrons into HF energy. The electrons decelerated in output resonator 2 are received by a collector ring 9 which coaxially encloses output resonator 2. The azimuthal angle width of electron beam 7 is adjustable in a range between 50° and 80° by means of a direct field which is superposed in input resonator 1 over the rotating HF field and which thus controls the size of the angle width of the negative cycle of the HF field.

Figure 2:
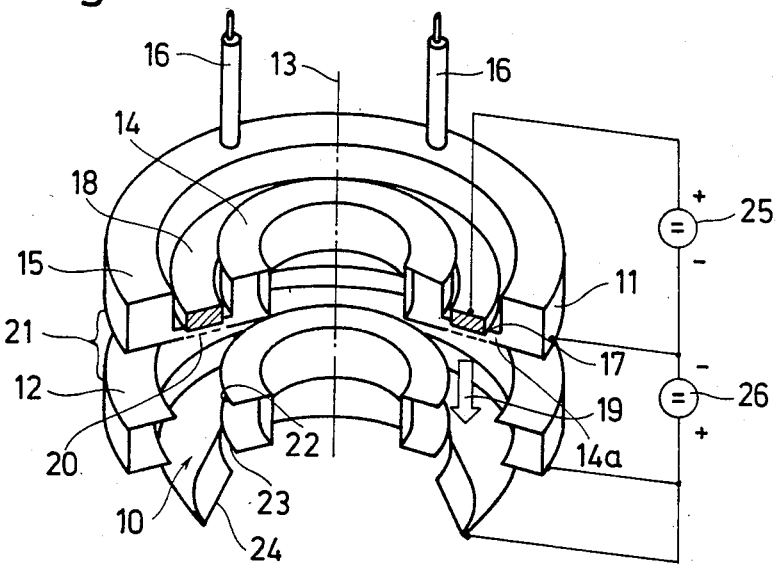
FIG. 2 is a perspective sectional view of an embodiment according to the invention of a cylindrical trirotron with an axial electron beam.

A UHF-power amplifier in the form of a cylindrical trirotron with an axial electron beam according to the present invention is shown in simplified perspective sectional view in FIG. 2. An input resonator 11 and an output resonator 12 each have the form of circular rings. The amplifier has an axial axis 13, and resonators 11 and 12 are arranged one behind the other in the direction of axis 13. Input and output resonators 11 and 12 each have a cross-section having an overall shape of a rectangle, the shorter side of which is arranged parallel to the direction of amplifier axis 13. Output resonator 12 is provided with a gap 10 having an entrance opening 22 and an exit opening 23. The center region of input resonator 11 is constricted to the shape of a small gap **14*a* which connects an inner ring 14 with an outer ring 15 and thus creates a U-shaped cross-section. This extends the current paths of the wall currents and increases the cutoff wavelength. Moreover, in addition to smaller dimensions, this results in an increase of the axial electrical field for a certain frequency in the region of gap 14*a***.

In the region of outer ring 15 or inner ring 14 of input resonator 11 two coupling loops 16 are angularly spaced by 90° from each other about axis 13. The high frequency is fed in through coupling loops 16 with a phase difference of 90° and at the same amplitudes so that a rotating wave is created in input resonator 11.

Input resonator 11 has an input gap 17 at the upper side of the constricted center region of input resonator 11 between inner ring 14 and outer ring 15. A cathode ring 18 is disposed in the constricted center region of input resonator 11 in front of gap 17. A grid ring 20 is disposed at the side of input resonator 11 opposite cathode ring 18 toward output resonator 12, in the direction of amplifier axis 13. A direct voltage acceleration path 21 is disposed between input resonator 11 and output resonator 12. Output resonator 12 is given a positive bias with respect to input resonator 11 by means of a direct voltage source 26 in order to accelerate electrons from input resonator 11 in the direction toward output resonator 12 along acceleration path 21. A collector ring 24 is positioned adjacent exit opening 23 for receiving electrons exiting from gap 10.

In operation, cathode ring 18 emits electrons during the negative halfwave of the HF oscillation. The HF wave rotates in input resonator 11 coaxially with amplifier axis 13 and generates a rotating electron beam 19 oriented parallel to amplifier axis 13 with the beam leaving input resonator 11 through grid ring 20 into direct voltage acceleration path 21. Electron beam 19, rotating azimuthally with the frequency of the HF wave of input resonator 11, passes through entrance opening 22 into output resonator 12, and there generates an HF wave which co-rotates with electron beam 19 and converts the kinetic energy of the electrons into HF energy thereby decelerating the electrons in the beam. The decelerated electrons leave output resonator 12 through exit opening 23 and are absorbed by collector ring 24.

The efficiency of the conversion of the kinetic energy of the electrons of electron beam 19 into the HF energy of the HF wave rotating in output resonator 12 increases as the azimuthal angle width of the electron beam entering output resonator 12 is reduced. For that reason, input resonator 11 is given a negative bias with respect to cathode ring 18 by means of a direct voltage source 25. As a result, the negative halfwave of the rotating HF wave only is effective for an angle section of less than 180°. If, in addition to cathode ring 18, the side of resonator 11 opposite cathode ring 18 toward output resonator 12 is simultaneously separated from the remainder of the resonator with respect to the direct voltage and the negative bias is given only to that side of input resonator 11 by means of the direct voltage source 25 while the remainder of the input resonator 11 and the cathode ring 18 are connected to the positive pole of direct voltage source 25, multiplication of the HF secondary emission (multipacting) can be reduced or completely avoided.

Figure 3:
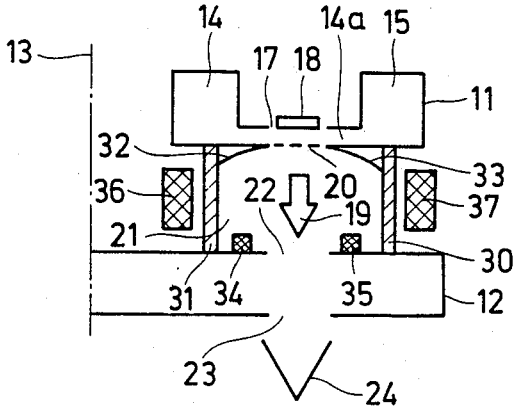
FIG. 3 is a schematic showing one-half of a sectional view of a cylindrical trirotron with a cylinder-shaped output resonator according to another embodiment of the invention.

FIG. 3 is a schematic showing one-half of a sectional view of a cylindrical trirotron in accordance with another embodiment of the invention. Cylindrical output resonator 12 is axially spaced from input resonator 11 by a first insulating ring 30 and a second insulating ring 31. Insulating rings 30 and 31 are arranged to be coaxial with one another and with amplifier axis 13. Instead of insulating rings 30 and 31, individual insulating rods can be used whch are equipped at their ends with mechanical elements which permit adjustment of the axial spacing between input resonator 11 and ouput resonator 12. Such an adjustment is much simpler than in the prior art trirotron shown in FIG. 1.

On the side of input resonator 11 facing acceleration path 21, focusing electrodes 32, 33 are disposed at both sides of grid ring 20. These focusing electrodes are at the same electrical potential as input resonator 11.

Subsequent focusing of electron beam 19 may also be effected with the aid of focusing coils 36, 37 which are designed as annular coils and are disposed in the region between input resonator 11 and output resonator 12.

An additional azimuthal velocity component may be imparted to electron beam 19 by positioning circular ring-shaped wound deflection coils 34, 35 in the region of entrance opening 22.

Figure 4:
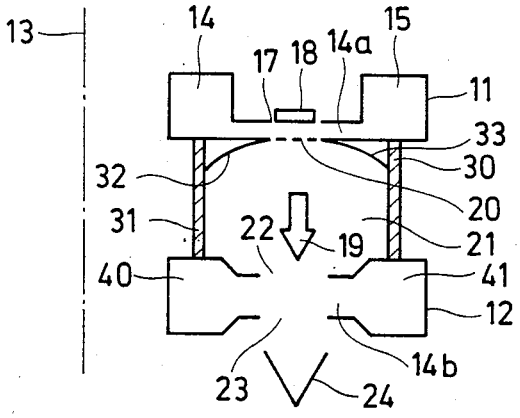
FIG. 4 is a schematic showing one-half of a sectional view of a cylindrical trirotron with an annular output resonator according to a further embodiment of the invention.

FIG. 4 is a schematic similar to FIG. 3 showing other modifications within the scope of the invention wherein output resonator 12 is a double ridge resonator equipped with a resonator gap **14*b* which connects an inner ring 40 with an outer ring 41 so that an H-shaped cross-section results. Alternatively, output resonator 12 may be constructed so that either only its side facing collector ring 24 is constricted which results in an inverted U-shaped cross-sectional profile, or only its side facing input resonator 11 is constricted which results in a U-shaped cross-sectional profile. Input resonator 11** may also be constructed to present an inverted U or H-shaped cross-section in lieu of the illustrated U-shaped cross-section. The dimensions of the embodiment of the invention vary because of the frequency range and the different scopes.

As a specific example some dimensions of the embodiment of the invention with respect to FIG. 2 are given in the following list for a 324 MHz-embodiment:

radial extension of cathode 18: 3 cm
height of gap **14*a* of input resonator 11**: 0,5 cm
length of acceleration path 21: 3 cm
inner radius of output resonator 12: 5 cm
outer radius of output resonator 12: 57.7 cm
height of output resonator 12: 10 cm
direct acceleration voltage 26: 100 kV The direct voltage 25 is dependent on the gap width of the desired current from the cathode and on the electrical UHF-field at the cathode. In this specific example the electrical HF-field can be in the range from 100 kV/m up to 400 kV/m and the direct voltage 25 varies from 200 V up to 2000 V.

The resonators and the collector could be made from OFHC-copper for example. The grid can be made from molybdenum or similar materials as used in high power tubes. The cathode is suggested to be a thermal cathode either directly or indirectly heated. An indirectly heated cathode can may comprise, for example, a porous tungsten cathode with about 18% porosity, impregnated with barium-calcium-aluminate.

It will be understood that the above description of the present invention is susceptible to various modifications, changes and adaptations and the same are intended to be comprehended within the meaning and range of equivalents of the appended claims.

What is claimed is:

1. A high frequency amplifier for a frequency range from 300 MHz to 3 GHz and having an output power in the megawatt range, said amplifier having an axial axis and comprising:

(a) means for generating a rotating electron beam including
  (1) a ring shaped input resonator which is rotationally symmetric with respect to the amplifier axis, said input resonator being formed to present an input gap concentric to the amplifier axis,
  (2) means for generating a high frequency electrical field in said input resonator, and
  (3) a cathode ring disposed in front of said input gap for generating the rotating electron beam in response to the high frequency electrical field;

(b) a ring shaped output resonator constructed for passage therethrough of the beam and for converting the kinetic energy of the electrons in the beam into high frequency power, said output resonator being rotationally symmetric with respect to the amplifier axis, axially spaced from said input resonator and electrically biased by a direct voltage potential difference with respect to said input resonator, wherein the axial space between said input resonator and said output resonator constitutes a direct voltage acceleration path for the electrons emitted from said beam generating means, the electron beam traverses the acceleration path within an annular cylindrical region coaxial with the amplifier axis, the electrons of the beam enter said output resonator with substantially identical velocities, and the kinetic energy of the electrons is converted in said output resonator to high frequency power in dependence on the azimuthal angle width of said beam;

(c) a grid ring disposed at the side of said input resonator between said cathode ring and said output resonator, the electron beam exiting said beam generating means through said grid ring and said grid ring restricting the passage of an electrical field from into said input resonator; and (d) a collector disposed on the side of said output resonator remote from said input resonator;

(e) wherein said beam generating means, said acceleration path, said output resonator and said collector are axially disposed one behind the other in the direction of the amplifier axis.

2. A high frequency amplifier according to claim 1, and further comprising direct electrical field generating means for adjusting the azimuthal angle width of the electron beam to a predetermined angle, said adjusting means including a direct voltage source having its positive pole connected to said cathode ring and its negative pole to said input resonator for generating a direct electrical field which is superposed on the high frequency electrical field in said input resonator.

3. A high frequency amplifier according to claim 1, wherein at least one of said input and output resonators is a circular ring formed by a rectangular surface the shorter side of which is parallel to the amplifier axis and which has a center region constricted in a direction parallel to the amplifier axis to form an inner ring and an outer ring connected by a resonator gap.

4. A high frequency amplifier according to claim 3, wherein said inner and outer rings and said resonator gap are arranged to present a U-shaped cross-section.

5. A high frequency amplifier according to claim 3, wherein said inner and outer rings and said resonator gap are arranged to present an inverted U-shaped cross-section.

6. A high frequency amplifier according to claim 3, wherein said inner and outer rings and said resonator gap are arranged to present an H-shaped cross-section.

7. A high frequency amplifier according to claim 1, wherein said output resonator is a circular cylinder having a rectangular cross-section, said rectangular cross-section having a shorter side that is disposed in a direction parallel to said amplifier axis.

8. A high frequency amplifier according to claim 1, and further comprising annular focusing electrodes disposed in the region of said grid ring, said focusing electrodes each being coaxial with the amplifier axis.

9. A high frequency amplifier according to claim 1, and further comprising focusing sources disposed in the region between said input and output resonators.

10. A high frequency amplifier according to claim 1, wherein said output resonator has a gap with an entrance opening through which the beam enters and passes through said output resonator, and further comprising circular ring-shaped wound deflection coils which impart an additional azimuthal velocity component to the beam, said deflection coils being disposed in the region of said entrance opening.

* * * * *